United States Patent [19]

Giebel et al.

[11] 4,315,341

[45] Feb. 16, 1982

[54] SHOE LASTING MACHINE

[75] Inventors: Gerhard Giebel, Bad Soden; Rolf Klein, Pirmasens, both of Fed. Rep. of Germany

[73] Assignee: USM Corporation, Farmington, Conn.

[21] Appl. No.: 144,332

[22] Filed: Apr. 28, 1980

[30] Foreign Application Priority Data

May 7, 1979 [DE] Fed. Rep. of Germany ..... 2918301

[51] Int. Cl.[3] ..... A43D 21/00

[52] U.S. Cl. ..... 12/10.5

[58] Field of Search ..... 12/10.1, 10.5, 14.5, 12/145

[56] References Cited

U.S. PATENT DOCUMENTS 3,025,541 3/1962 Weinschenk ..... 12/10.1

3,097,379 7/1963 Hawkins ..... 12/10.1

4,205,409 6/1980 Walega ..... 12/10.5

*Primary Examiner*—Patrick D. Lawson

*Attorney, Agent, or Firm*—Donald N. Halgren

[57] ABSTRACT

In a pulling over and toe lasting machine, the pincers first grip the lasting margin above the wiping plane, whereafter the upper is tensioned about its last by upward movement of the last support, from an initial, lowered, position to a position in which the last bottom is in the wiping plane, and by downward movement of the pincers. The machine also comprises auxiliary means by which any wiper remaining in the wiping plane after the upper has been tensioned as aforesaid can be moved downwardly out of said plane so as not to impede the in-wiping movement of the wipers. When the auxiliary means is actuated, furthermore, the gripping force applied by the pincers to the upper is reduced to allow slippage of the upper in the pincers.

9 Claims, 4 Drawing Figures

SHOE LASTING MACHINE

This invention is concerned with machines for pulling over and toe lasting shoes. The term "shoes" where used herein is to be understood as indicating articles of outer footwear generally and as including articles of outer footwear in the course of their manufacture.

One machine for pulling over and toe lasting shoes is known, which machine comprises a support for supporting, bottom down, a last carrying a shoe upper and an insole, a plurality of pincers arranged about the last support for gripping marginal portions of an upper carried on its last supported by the last support, means for varying the gripping force applied by the pincers, and a toe lasting wiper assembly comprising wiper plates mounted in a wiping plane for in-wiping movement, wherein means is provided for moving the last support from an initial, lowered, position into a position in which the bottom of a last supported thereby is in the wiping plane and for lowering the pincers relative to the last support whereby, with a firm gripping force applied to the upper by the pincers, the upper is tensioned over its last.

In the aforementioned machine, the pincers are so mounted that, in their uppermost position, they remain below the wiping plane. Consequently, especially when operating on shoe uppers which are cut with relatively small margins, it is necessary for the initial, lowered, position of the last support to be well below the wiping plane, in order that the margins of the upper, carried by its last supported on the last support, can be fed into the pincers prior to being gripped thereby. Not only does such an arrangement require a relatively large space through which the last support is thus caused to travel, to bring the last supported thereby to a position in which its bottom is in the wiping plane, but in addition, where the machine is pneumatically operated, a piston-and-cylinder arrangement is required having a relatively long stroke.

Furthermore, in the operation of said machine, the upward movement of the last support is in two stages, the first being effected while the upper is gripped by the pincers with a firm gripping force, and the second while a reduced, slipping, gripping force is applied. In said machine, therefore, once the upper has been tensioned, to the satisfaction of the operator, on its last, the last support, with the last and tensioned upper, has then to be raised to bring the last bottom into the wiping plane, while the slipping gripping force is applied to the upper by the pincers, thereby giving rise to a risk that the position of the upper on its last can be disturbed. Furthermore, in said machine, the wipers cannot move inwardly until the last support has completed its second stage of movement, and thus has reached its position in which the bottom of the last supported thereby is in the wiping plane. Thus, the in-wiping of the wipers is delayed by the time taken to effect such second stage of movement of the last support, and the machine cycle time is thus extended.

It is thus the object of the present invention to provide an improved machine for pulling over and toe lasting shoes in which so-called short-cut uppers can readily be pulled over and lasted, but in which the time required between the tensioning of the upper and the inward movement of the wipers, and also the space requirements for the means for moving the last support are reduced, and further the risk of disturbing the tensioned upper on its last is diminished.

The invention thus provides a machine for pulling over and toe lasting shoes comprising a support for supporting, bottom down, a last carrying a shoe upper and an insole, a plurality of pincers arranged about the last support for gripping marginal portions of an upper carried on its last supported by the last support, means for varying the gripping force applied by the pincers, and a toe lasting wiper assembly comprising wiper plates mounted in a wiping plane for in-wiping movement, wherein means is provided for moving the last support from an initial, lowered, position into a position in which the bottom of a last supported thereby is in the wiping plane and for lowering the pincers relative to the last support whereby, with a firm gripping force applied to the upper by the pincers, the upper is tensioned over its last, and further wherein the pincers can be arranged above the wiping plane at the start of the machine cycle, auxiliary means being provided whereby any pincer remaining in the wiping plane after the upper has been tensioned as aforesaid can be moved downwardly out of said plane so as not to impede the in-wiping movement of the wipers, the gripping force applied by the pincers to the upper being reduced thus to allow slippage of the upper therein.

It will thus be appreciated that by positioning the pincer above the wiping plane at the start of the machine cycle, the length of the up-stroke of the last support, and thus the length of the piston-and-cylinder arrangement effecting such up-stroke can be reduced. Furthermore, by the time the upper is correctly tensioned on its last, the last support has been brought to its position in which the bottom of the last is in the wiping plane. Furthermore, in many instances at least some of the pincers will have been moved, during the tensioning of the upper on its last, downwardly below the wiping plane and the auxiiary means then serves merely to ensure that any pincer remaining in the wiping plane after tensioning is moved out of said plane at the appropriate time. In this way, not only is the risk of disturbing the upper tensioned on its last reduced, since the upper will be held by most of the pincers and only certain of them will be moved relative to the upper at this time, but also the possibility is provided of shortening the cycle time by the sequencing of the in-wiping movement of the wipers with the action of the auxiliary means.

In the machine in accordance with the invention the menas for lowering the pincers conveniently comprises a plurality of fluid pressure operated piston-and-cylinder arrangements, one connected with each pincer, and further the auxiliary means is arranged to act through the connection between any pincer remaining in the wiping plane as aforesaid and its piston-and-cylinder arrangement. More specifically, the connection between each pincer and its piston-and-cylinder arrangement conveniently comprises a movable connecting member, and the auxiliary means comprises cam means arranged to act on said connecting member, thus to cause it to move and cause its associated pincer to be moved out of the wiping plane as aforesaid. In the machine in accordance with the invention, the connecting member may be mounted for pivotal movement and in addition the cam means may comprise a cam member (or individual cam members) also mounted for pivotal movement. The auxiliary means preferably also comprises fluid pressure operated means for moving the cam means through a predetermined stroke. Furthermore, the cam means is preferably arranged to operate, at the end of its stroke, a detecting device, e.g. a safety switch or valve, controlling the in-wiping movement of the wipers.

In the latter case, it will be appreciated that the in-wiping movement of the wipers may still be delayed until the pincers are moved out of the wiping plane. In order to further reduce the machine cycle time, as an alternative to the aforementioned arrangement, the cam means may be actuated by means of a Bowden cable connection with means, forming part of the toe lasting wiper assembly, by which means the in-wiping movement of the wipers is caused to take place. In such a case, actuation of the last-mentioned means will be effective to ensure that any pincer remaining in the wiping plane after the upper has been tensioned as aforesaid is moved out of said plane during the in-wiping movement of the wipers. Furthermore, such an arrangement dispenses with the fluid pressure operated means forming part of the auxiliary means and also with the detecting device and any necessary circuitry associated therewith.

In the machine in accordance with the invention, each connecting member, which may be connected to its associated pincer by means of a Bowden cable, conveniently has associated therewith an operator-controlled handle operable, at a stage in the machine cycle at which a firm gripping force is applied by each pincer, to move its associated pincer downwardly relative to the last support, for correcting the position of the tensioned upper on its last. Thus, when the machine is in use, after the upper has been tensioned as above described, further "discretionary" tensioning of the upper can take place under the control of the operator, the next stage in the machine cycle being initiated when the operator is satisfied with the position of the upper on its last.

Towards the end of the machine cycle, as the wipers have moved fully inwardly, it will be appreciated that the upper will have been drawn out of each of the pincers, applying a slipping gripping force at this stage. In order to prevent each such released gripper from being forced downwardly to its bottom position by its associated piston-and-cylinder arrangement at this stage, preferably, when the auxiliary means is actuated as aforesaid, a balancing pressure is applied to each side of each such piston-and-cylinder arrangement. To this end, preferably each such arrangement is double-acting, the balancing pressure being provided by fluid pressure.

There now follows a detailed description, to be read with reference to the accompanying drawings, of one machine in accordance with the invention, such machine having been selected for description merely by way of exemplification of the invention and not by way of limitation thereof.

Figure 1:
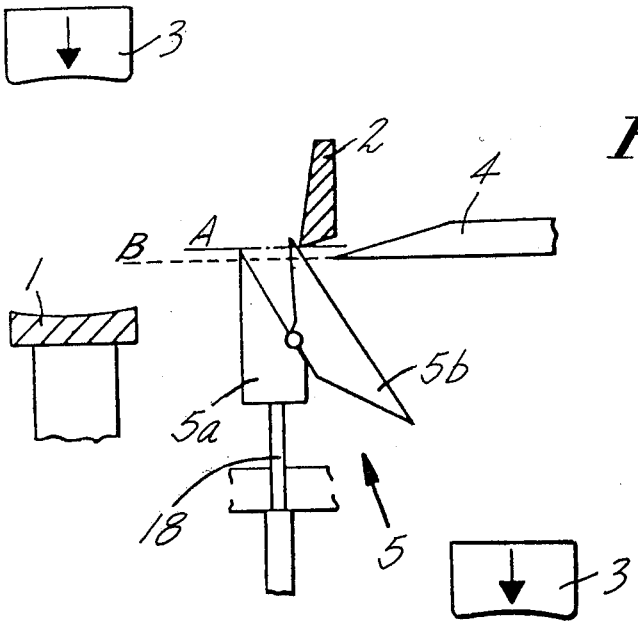
FIG. 1 is a diagram showing principal components of the machine in a rest position.

In FIG. 1 is shown a last support 1, a pincer generally designated 5 and comprising a fixed jaw 5*a* and movable jaw 5*b* (the machine comprising a plurality of such pincers located around the last support 1 in the conventional manner), a toe band 2, a toe pad 3 and a wiper 4 forming part of a toe lasting wiper assembly including two wiper plates in the usual manner. As can be seen from FIG. 1, the pincer 5 projects upwardly beyond a wiping plane B defined by the plane of the wiper 4. A represents a plane of the bottom of the toe band 2.

Figure 2:
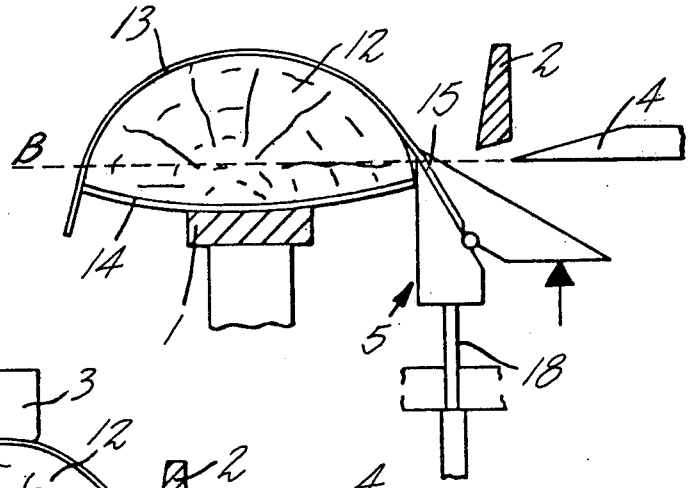
FIG. 2 shows the various components in an initial position with a last, carrying an upper and insole, supported by the last support.

In FIG. 2 a last 12 carrying an upper 13 and having an insole 14 attached to the bottom thereof is placed on the last sypport 1 and a lasting marginal portion 15 of the upper is inserted into the jaws 5*a*, 5*b* of the pincer, the jaws then being closed by pivoting the movable jaw 5*b* (as indicated by the arrow). It will be appreciated that, at this stage, the last bottom lies below the wiping plane B.

Figure 3:
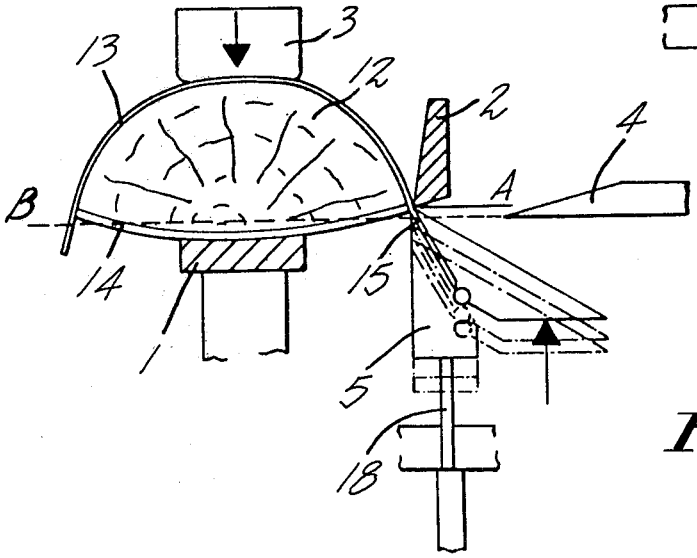
FIG. 3 shows the various components with the upper tensioned over its last.

In FIG. 3, the last support 1 has been raised from its initial, lowered, position into a position in which the bottom of the last 12 supported thereby lies in the wiping plane B, such upward movement of the last support 1 being effected by fluid pressure operated means (not shown). Also, the pincer 5 is urged downwardly by a fluid pressure operated piston-and-cylinder arrangement 7 (hereinafter described with reference to FIG. 4) which applies a downward force, which can be regulated according to the material of the upper 13. In FIG. 3, three positions of the pincer 5 are indicated, that shown in solid line indicating the position of the pincer where the leather is relatively hard, or the applied downward force is relatively low (as may be the case with certain delicate types of leather), while the positions shown in chain dot line would indicate the end positions of the pincer where the upper material is relatively stretchy or the applied force is relatively high. As shown in FIG. 3, the upper 13 is thus tensioned over its last 12 and maintained tensioned by the action of the pincers. In order to ensure that the upper is firmly held by the pincers during the tensioning of the upper, the force applied to the movable jaw 5*b* is relatively high, so that a firm gripping force is applied to the upper by the pincer 5, such force continuing to be applied to maintain the tension in the upper at this stage. Also at this stage, the toe pad 3 is moved downwardly to clamp the last against the last support 1, and in addition the toe band 2 is moved to embrace the toe end of the shoe in the region of the feather line of the shoe.

It will be appreciated that, in the position of the pincer 5 shown in FIG. 3, said pincer still projects into the wiping plane so that it would impede the in-wiping movement of the wiper 4 if actuated at this stage. (It will be appreciated, of course, that using a full set of pincers some of the pincers will be moved out of the wiping plane during the tensioning of the upper, while other pincers may remain in the wiping plane, according to the particular portion of upper to be stretched by the particular pincer.)

Figure 4:
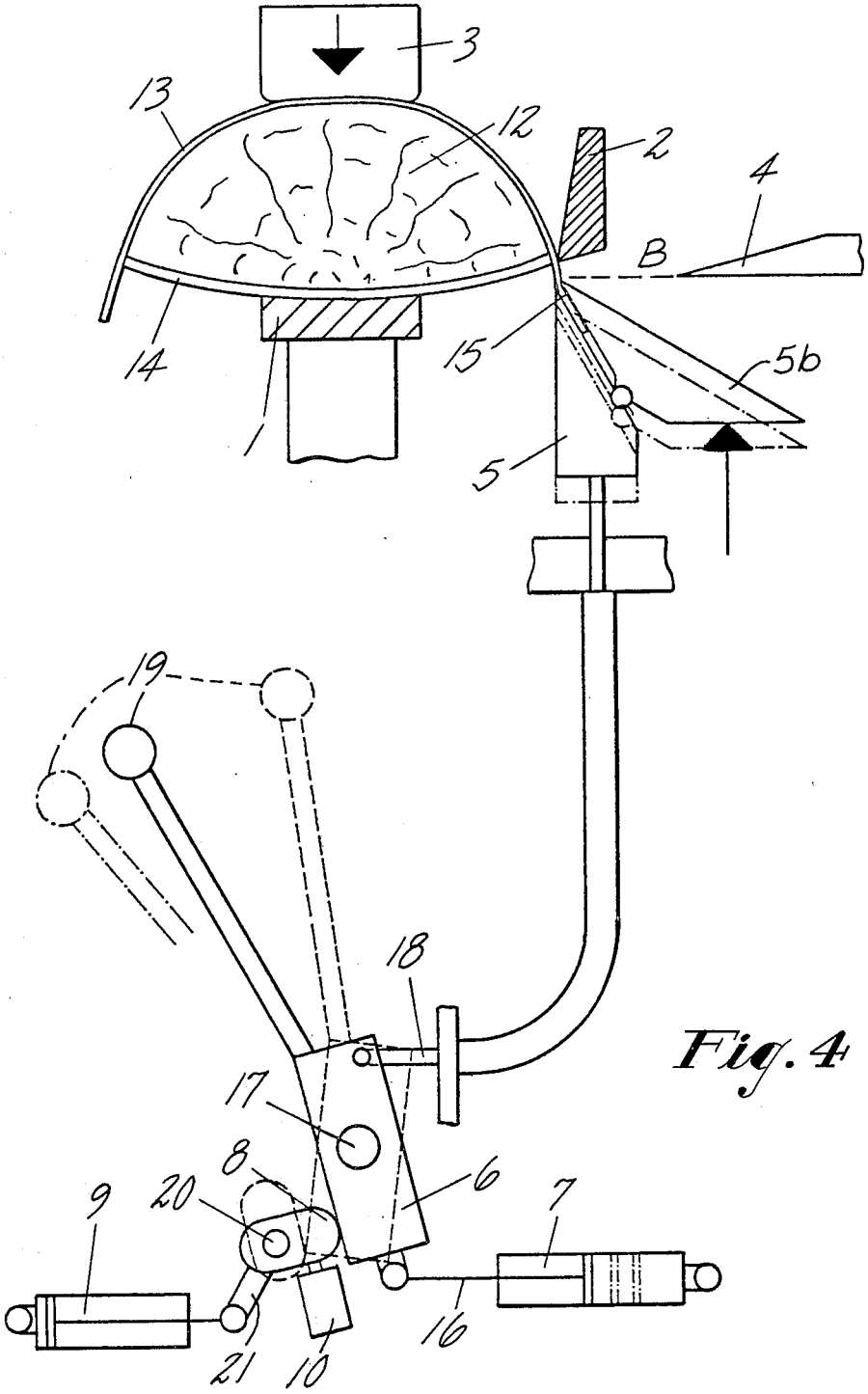
FIG. 4 is a diagram showing auxiliary means of the machine, and shows the position of the various components immediately before in-wiping of the wipers.

In FIG. 4 is shown details of the means for moving the pincer 5 downwardly, said means comprising a Bowden cable connection 18 between the pincer 5 and a connecting member 6 which is mounted for pivotal movement on a cross-shaft 17 of the machine (said cross-shaft carrying a plurality of such connecting members, one associated with each pincer). The (or each) connecting member 6 is connected to a piston rod 16 of the piston-and-cylinder arrangement 7, which is double-acting (for purposes to be hereinafter described). Admission of fluid under pressure to said arrangement 7 at the appropriate side is thus effective, through the connecting member 6 and Bowden cable connection 18, to draw the pincer 5 downwardly. Furthermore, the connecting member 6 also carries an operator-controlled handle 19 by which, after the upper has been tensioned as aforesaid on its last, the operator can apply "discretionary" forces through the various pincers in order to ensure that the upper is properly positioned on the last prior to initiation of the in-wiping movement of the wipers 4.

In FIG. 4, furthermore, is also shown one form of auxiliary means whereby any pincer 5 remaining in the wiping plane B after the upper 13 has been tensioned on its last 12 as aforesaid can be moved downwardly out of said plane so as not to impede the in-wiping movement of the wipers 4. The auxiliary means comprises a cam member 8 mounted for pivotal movement on a further cross-shaft 20 which is caused to rotate by means of a piston-and-cylinder arrangement 9 the piston rod of which is connected to a lever 21 also carried on said cross-shaft 20. As the cross-shaft 20 is caused to rotate, the cam member 8 is pivoted and engages with the connecting member 6 of any pincer which remains in the wiping plane, the arrangement being such that such engagement is effective further to pivot the connecting member 6 about its shaft 17 so that, through the Bowden cable connection 18, said pincer is drawn downwardly out of the wiping plane B. If the wiper has been moved out of the wiping plane B during the tensioning of the upper, on the other hand, the cam member 8 will be ineffective to move it further.

In order to prevent such downward movement of the pincer 5 under the control of the auxiliary means from being resisted by the tension in the upper, at this stage the force applied to the movable aw 5*b* is reduced, thereby reducing the gripping force applied by the pincer 5 to the upper to a slipping gripping force, enabling the pincer 5 to slide along the lasting marginal portion of the upper gripped thereby as such downward movement is effected. (Furthermore, the slipping gripping force is maintained as the wipers 4 subsequently effect their in-wiping movement, the arrangement being that the wipers gradually draw the lasting marginal portions of the upper 13 out of all the pincers, wipe them over corresponding marginal portions of the insole 14, and hold them thereagainst while they become secured to said corresponding marginal portions of the insole, e.g. by adhesive previously applied therebetween.)

It will thus be appreciated that, whether or not any pincer remains in the wiping plane after the upper has been tensioned as aforesaid, the cam 8 will effect a full stroke under the action of the piston-and-cylinder arrangement 9. Furthermore, at the end of said stroke the cam member 8 is arranged to operate a detecting device in the form of a safety valve 10 which controls the in-wiping movement of the wipers 4, the arrangement being such that the in-wiping movement of the wipers can be actuated only upon actuation of said valve 10. Thus, the wiper assembly 4 can be actuated only when any wiper remaining in the wiping plane B after the upper has been tensioned has been moved downwardly out of said plane.

As an alternative to the aforementioned arrangement, the fluid pressure operated means for actuating the in-wiping movement of the wipers 4 may be connected by a Bowden cable (not shown) to the lever 21 on the cross-shaft 20, so that, as the in-wiping movement of the wipers 4 is initiated, the cross-shaft 20 is caused to rotate, thereby pivoting the cam member 8 in the manner described above. In such a case, of course, the safety valve 10 and also the (or each) piston-and-cylinder ) arrangement 9 can be dispensed with.

As already referred to above, the slipping gripping force applied by the pincers is such that the lasting marginal portions of the upper will gradually be drawn out of the pincers as the wipers effect their in-wiping movement. In order to prevent each wiper, upon completely releasing its upper, from being drawn downwardly, perhaps with some impact, by its piston-and-cylinder arrangement 7, at the same time as the auxiliary means is actuated as aforesaid, fluid pressure, effecting a balancing pressure, is also applied to the other side of the piston-and-cylinder arrangement 7 which is, as above mentioned, double-acting. In this way, the pincer will be retained in its position after the upper has completely slipped from the jaws thereof.

We claim:

1. Machine for pulling over and toe lasting shoes comprising a support for supporting, bottom down, a last carrying a shoe upper and an insole, a plurality of pincers arranged about the last support for gripping marginal portions of an upper carried on its last supported by the last support, variable gripping force pincers, and a toe lasting wiper assembly comprising wiper plates mounted in a wiping plane for in-wiping movement, wherein the last support may be moved from an initial, lowered position into a position in which the bottom of a last supported thereby is in the wiping plane and for lowering the pincers relative to the last support whereby, with a firm gripping force applied to the upper by the pincers, the upper is tensioned over its last, and further wherein the pincers can be arranged above the wiping plane at the start of the machine cycle, auxiliary means being provided whereby any pincer remaining in the wiping plane after the upper has been tensioned as aforesaid can be moved downwardly out of said plane so as not to impede the in-wiping movement of the wipers, the gripping force applied by the pincers to the upper being reducible thus to allow slippage of the upper therein, said means for lowering the pincers comprises a plurality of fluid pressure operated piston-and-cylinder arrangements, one connected with each pincer, and wherein the auxiliary means is arranged to act through the connection between any pincer remaining in the wiping plane as aforesaid and its piston-and-cylinder arrangement, said connection between each pincer and its piston-and-cylinder arrangement comprises a movable connecting member, and wherein the auxiliary means comprises cam means arranged to act on said connecting member thus to cause it to move and to cause its associated pincer to be moved out of the wiping plane as aforesaid.

2. Machine according to claim 1 wherein the means for lowering the pincers comprises a plurality of fluid pressure operated piston-and-cylinder arrangements, one connected with each pincer, and wherein the auxiliary means is arranged to act through the connection between any pincer remaining in the wiping plane as aforesaid and its piston-and-cylinder arrangement.

3. Machine according to claim 2 wherein the connection between each pincer and its piston-and-cylinder arrangement comprises a movable connecting member, and wherein the auxiliary means comprises cam means arranged to act on said connecting member thus to cause it to move and to cause its associated pincer to be moved out of the wiping plane as aforesaid.

4. Machine according to claim 3 wherein the connecting member is connected to its associated pincer by means of a Bowden cable.

5. Machine according to either one of claims 3 and 4 wherein each connecting member has associated therewith an operator-controlled handle operable, at a stage in the machine cycle at which a firm gripping force is applied by each pincer, to move its associated pincer downwardly relative to the last support, for correcting the position of the tensioned upper on its last.

6. Machine according to any one of claims 3 to 5 wherein the auxiliary means also comprises fluid pressure operated means for moving the cam means through a predetermined stroke.

7. Machine according to claim 6 wherein the cam means is arranged to operate, at the end of its stroke, a detecting device controlling the in-wiping movement of the wipers.

8. Machine according to any one of claims 2 to 7 wherein, when the auxiliary means is actuated as aforesaid, a balancing pressure is applied to each side of each piston-and-cylinder arrangement of the means for lowering the pincers.

9. Machine according to claim 8 wherein each piston-and-cylinder arrangement is double-acting, the balancing pressure being provided by fluid pressure.

* * * * *